United States Patent [19]

Shiragami et al.

[11] Patent Number: 4,605,482

[45] Date of Patent: Aug. 12, 1986

[54] FILTER PRESS TYPE ELECTROLYTIC CELL

[75] Inventors: Osamu Shiragami, Funabashi; Toshihiko Kuno, Ichihara; Yasuo Sajima, Yokohama; Kohji Saito, Chiba; Takahiro Uchibori; Junjiro Iwamoto, both of Yokohama, all of Japan

[73] Assignee: Asahi Glass Company, Ltd., Tokyo, Japan

[21] Appl. No.: 367,386

[22] Filed: Apr. 12, 1982

[30] Foreign Application Priority Data

| | | | |
|---|---|---|---|
| Apr. 28, 1981 | [JP] | Japan | 56-63378 |
| May 26, 1981 | [JP] | Japan | 56-78686 |
| Oct. 20, 1981 | [JP] | Japan | 56-166448 |

[51] Int. Cl.[4] ..... C25B 9/00; C25B 11/03; C25B 11/20

[52] U.S. Cl. ..... 204/258; 204/283

[58] Field of Search ..... 204/267, 268, 269, 270, 204/275, 277, 278, 98, 258, 266, 283

[56] References Cited

U.S. PATENT DOCUMENTS

| | | | |
|---|---|---|---|
| 3,123,545 | 3/1964 | Williams | 204/224 |
| 3,222,270 | 3/1959 | Edwards | 204/269 |
| 3,657,099 | 4/1972 | Seko et al. | 204/253 |
| 4,252,628 | 2/1981 | Boulton et al. | 204/284 |
| 4,464,243 | 8/1984 | Woolhouse | 204/257 |

*Primary Examiner*—Donald R. Valentine

*Attorney, Agent, or Firm*—Oblon, Fisher, Spivak, McClelland & Maier

[57] ABSTRACT

A filter press type ion exchange membrane electrolytic cell which comprises an anode compartment and a cathode compartment partitioned by a cation exchange membrane and which is useful for obtaining a halogen, hydrogen and an alkali metal hydroxide from an alkali metal halide aqueous solution, or oxygen and hydrogen from an aqueous alkaline solution. The filter press type electrolytic cell is characterized by:

(a) an anode compartment frame and a cathode compartment frame, each having an opening at its center constituting the anode compartment or the cathode compartment and four holes in the vicinity of its corners constituting passages for (1) an alkali metal halide aqueous solution or an aqueous alkaline solution, (2) a depleted brine and a halogen gas, or an aqueous alkaline solution and an oxygen gas, (3) water or a dilute alkali metal hydroxide aqueous solution and (4) an alkali metal hydroxide aqueous solution and a hydrogen gas, the former two holes being in communication with the opening constituting the anode compartment, and the latter two openings being in communication with the opening constituting the cathode compartment, (b) a cation exchange membrane having four holes at positions corresponding to the four holes provided on the anode compartment frame and the cathode compartment frame, or a cation exchange membrane having no such four holes and being smaller than said compartment frame but slightly larger than said openings of the compartment frames, (c) an anode and a cathode having no four holes and being slightly larger than the openings of the anode compartment frame and the cathode compartment frame and smaller than the compartment frames, wherein a unit comprising said cathode compartment frame and said cathode disposed on each side thereof and a unit comprising said anode compartment frame and said anode disposed on each side thereof are alternately arranged via said cation exchange membrane, or wherein a unit comprising said anode and said anode compartment frame disposed on one side or each side thereof and a unit comprising said cathode and said cathode compartment frame disposed on one side or each side thereof are alternately arranged via said cation exchange membrane.

13 Claims, 6 Drawing Figures

FILTER PRESS TYPE ELECTROLYTIC CELL

BACKGROUND OF THE INVENTION

1. Field of the Invention

The present invention relates to an electrolytic cell useful for the production of a halogen and an alkali metal hydroxide from an alkali metal halide aqueous solution or oxygen and hydrogen from an aqueous alkaline solution, and particularly to a filter press type membrane electrolytic cell.

2. Description of the Prior Art

Various filter press type membrane electrolytic cells are known in which a number of anodes and cathodes are alternately arranged in parallel to one another and partitioned from one another by a cation exchange membrane.

On the other hand, a so-called electrodialysis operation has long been known in which an aqueous solution containing ions are supplied to two compartments partitioned by an ion exchange membrane, and an electric field is applied to remove the ions or to concentrate useful ions. It is practically employed for the production of sodium chloride from sea water or as a technique to obtain fresh water from sea water. Electrolysis is substantially different from the case of an electrodialysis cell in that it involves an electrode reaction on the surface of an electrode and the presence of an electrode surface is thereby essential, and in the electrolysis of an alkali metal chloride aqueous solution, a chlorine gas is generated at the anode and a hydrogen gas is generated at the cathode.

In a conventional filter press type electrolytic cell, it is known to use e.g. angular hollow pipes constituting passages for an electrolytic solution and electrolized products and joined to form hollow rectangular frames defining electrode compartments, i.e. so-called hollow compartment frames.

The electrolytic cell having such hollow compartment frames is fairly effective and useful. However, the compartment frames are manufactured from hollow pipes of expensive material, and accordingly, the cost of the cell becomes inevitably high involving the expensive material and manufacturing costs.

A so-called plate type electrolytic cell has been proposed to overcome the disadvantage of the abovementioned pipe type electrolytic cell, in which a rectangular frame gasket made of a plate is used as the compartment frame. An electrolytic cell of this type is disclosed in e.g. Japanese Laid-Open Patent Application No. 108899/78, in which compartment frame gaskets made of a non-conductive flexible plate material and having a center opening constituting an electrolytic compartment, are assembled with cation exchange membranes and electrode plates to form a filter press type electrolytic cell, and the respective compartment frames, electrode plates and cation exchange membranes are provided, at their four corner portions, with holes constituting passages for the electrolytic solutions and the electrolyzed products.

From the aspect of the manufacturing costs, the electrolytic cell of this type is substantially advantageous over the abovementioned cell in which hollow pipes are used. However, it has certain drawbacks in the structures of the electrode plates and the compartment frames.

Namely, in the electrolytic cell of the type disclosed in the abovementioned Japanese Laid-Open Patent Application, the electrode plates have the same size as the compartment frames, and accordingly it is necessary to provide holes not only on the compartment frames but also at the four corners of each electrode plate to constitute passages for the electrolytic solution and the electrolyzed products. This brings about not only an economical disadvantage that a great amount of expensive electrode plates is required but also a fatal defect. Namely, with respect to the anode plates in order to prevent electrical short circuit, it is necessary to electrically insulate the passages formed on the anode plates for the cathode solution and the cathode products from the anodes. Likewise, with respect to the cathode plates, it is necessary to electrically insulate the passages formed on the cathode plates for the anode solution and the anode products from the cathodes. In this respect, the abovementioned Japanese Laid-Open Patent Application states that it is necessary to form the passages with a resin, e.g. a fluorine-containing resin such as Teflon to establish the required electrical insulation. However, it is quite cumbersome to form such portions of the electrode plates with a material of different nature, and such an operation is economically extremely disadvantageous.

SUMMARY OF THE INVENTION

The present inventors have conducted various studies to solve the abovementioned problems, and as a result, have accomplished the present invention.

The present invention provides a filter press type ion exchange membrane electrolytic cell which comprises an anode compartment and a cathode compartment partitioned by a cation exchange membrane and which is useful for obtaining a halogen, hydrogen and an alkali metal hydroxide from an alkali metal halide aqueous solution, or oxygen and hydrogen from an aqueous alkaline solution. The filter press type electrolytic cell is characterized by:

(a) an anode compartment frame and a cathode compartment frame, each having an opening at its center constituting the anode compartment or the cathode compartment and four holes in the vicinity of its corners constituting passages for (1) an alkali metal halide aqueous solution or an aqueous alkaline solution, (2) a depleted brine and a halogen gas, or an aqueous alkaline solution and an oxygen gas, (3) water or a dilute alkali metal hydroxide aqueous solution and (4) an alkali metal hydroxide aqueous solution and a hydrogen gas, the former two holes being in communication with the opening constituting the anode compartment, and the latter two openings being in communication with the opening constituting the cathode compartment, (b) a cation exchange membrane having four holes at positions corresponding to the four holes provided on the anode compartment frame and the cathode compartment frame, or a cation exchange membrane having no such four holes and being smaller than said compartment frame but slightly larger than said openings of the compartment frames, (c) an anode and a cathode having no four holes and being slightly larger than the openings of the anode compartment frame and the cathode compartment frame and smaller than the compartment frames, wherein a unit comprising said cathode compartment frame and said cathode disposed on each side thereof and a unit comprising said anode compartment frame and said anode disposed on each side thereof are alternately arranged via said cation exchange membrane, or wherein a unit comprising said anode and said anode compartment frame disposed on one side or each side thereof and a unit comprising said cathode and said cathode compartment frame disposed on one side or each side thereof are alternately arranged via said cation exchange membrane.

Thus, in the electrolytic cell according to the present invention, the electrode plates have no holes at their four corner portions, and they are slightly larger than the electrode compartments to cover the latter, whereby it is possible to overcome the various disadvantages of the electrolytic cell disclosed in the abovementioned Japanese Laid-Open Patent Application.

DETAILED DESCRIPTION OF THE PREFERRED EMBODIMENTS

Figure 1:
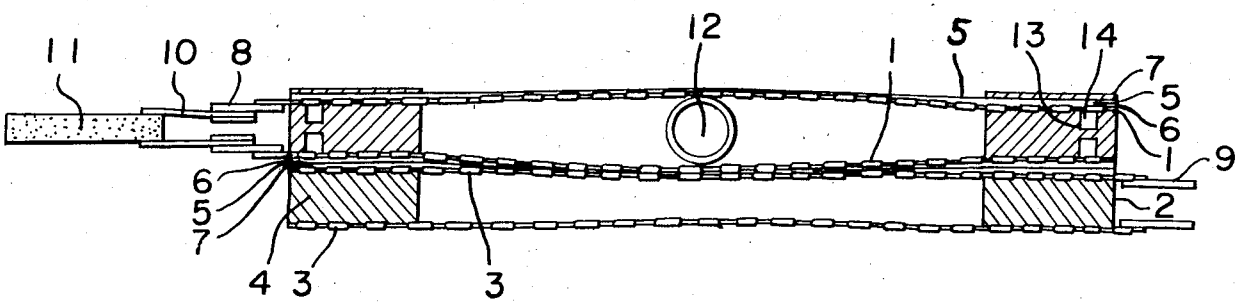
FIG. 1 is a horizontally cross sectional view of a first embodiment of the electrolytic cell of the present invention and illustrates a monopolar cell comprising one cathode cell and one anode cell.

Now, the present invention will be described with reference to a preferred embodiment.

In a plate type electrolytic cell as disclosed in the abovementioned Japanese Laid-Open Patent Application, an electrode plate is sandwiched between compartment frames having a rectangular center opening. This electrode is prepared by providing a slit on the electrode surface and pushing the slit open to form a louver shape, and consequently, inevitably has a structure in which the flange surface is not flush with the electrode surface. In recent years, there is a trend for an energy-saving type electrolytic technique, and an effort has been made to minimize the distance between the electrodes. With the structure as disclosed in the abovementioned Japanese Laid-Open Patent Application, if it is attempted to minimize the distance between the electrodes, it is likely to lead to a rupture of the ion exchange membrane at the unleveled portion between the electrode surface and the flange surface. Further, in a zero-gap electrolytic cell (i.e. an electrolytic cell in which the electrode and the membrane substantially contact), it is desired to use a foraminous electrode having smaller perforations in order to obtain a uniform electric current distribution in the vicinity of the electrode surface and to maintain the voltage at a low level. In respect of such a requirement, in the electrolytic cell disclosed in the abovementioned prior art reference, it is difficult to form an electrode having small perforations by the plate itself because of the restrictions of the functionality and the mechanical strength, and it is necessary to attach a separate electrode member such as an expanded metal having small perforations to a flange or a punched plate by means of e.g. welding. This adds to the manufacturing costs of the electrodes plates. Besides, the welded portions are located in the electrode compartments and get in contact with the ion exchange membranes, and therefore, this is undesirable from the standpoint of the use of the ion exchange membrane.

Accordingly, as the electrode plate to be used in the electrolytic cell according to the present invention, it is preferred to use an electrode plate in which the electrode portion is flush with the sealing portion facing the compartment frame. Specific types of the electrode plate include a punched metal, an expanded metal made flat over the entire surface, and a wire mesh with its sealing portion made flat. When a punched metal is used as the porous electrode plate, the sealing portion may be left without forming perforations, whereby liquid-tight sealing between the compartment frame and the ion exchange membrane can be facilitated. Further, the edges of the perforations of the punched metal are rounded on one side of the punched metal, and the ion exchange membrane may be disposed to face that side of the punched metal, whereby damages of the ion exchange membrane caused by the edges of the perforations can thereby be avoided. For these reasons, the punched metal is particularly preferred as an embodiment of the electrode plate of the present invention.

In the case where the foraminous electrode plate is made of an expanded metal which has been made flat over the entire surface, it is possible to attach along the periphery thereof, a flat frame having substantially the same thickness as the porous electrode plate by e.g. welding so as not to form a stepped portion. However, it is also possible to use the expanded metal per se to extend to the sealing portion, without attaching a special flange, and the portion of the expanded metal to contact the compartment frame is directly or via a packing sandwiched between the compartment frame and the ion exchange membrane. When an elastic material (for instance, a rubber such as EPDM) is used as the compartment frame, no liquid leaking will occur even when a packing is not used. However, in order to ensure the liquid-tight sealing, it is desirable to provide a packing at least on one side of the cation exchange membrane.

In a case where a resin having relatively small elasticity is used as the compartment frame, it is necessary to provide a packing at each side of the cation exchange membrane. It is rather surprising that with such a construction, liquid leakage can completely be prevented. In the case of a wire mesh, a construction similar to the case of the expanded metal can be employed.

The feature of this first embodiment resides in that the abovementioned electrode is a porous electrode of a flat plate shape integrally formed with and being flush with the sealing portion facing the compartment frame. As another feature of this embodiment, there may be mentioned that the current input from outside to the electrode surface and the current output to outside are conducted solely by a flat foraminous electrode plate which essentially constitutes the electrode base body, whereby electrical connections to conductive ribs or conductive plates by means of welding or a bolt fastening structure, which are otherwise required at the portion where the electrode surface faces the cation exchange membrane, can be eliminated, and accordingly possible roughening of the electrode surface or formation of stepped portions which may otherwise result by such electrical connections, can be eliminated.

Now, the abovementioned embodiment will be described with reference to the drawings.

FIG. 1 is a horizontally cross sectional view of a first embodiment of the electrolytic cell of the present invention comprising one cathode cell and one anode cell and illustrates a monopolar cell. Foraminous anode plates 1 are a known type composed of an expanded metal made of e.g. titanium and made flat by roll pressing and ruthenium oxide coated thereon, and they are held without flanges against the respective sides of the anode compartment frame. The foraminous anode plates 1 may be secured to the respective sides of the compartment frame by placing them against the sides of the frame and holding them to the frame simply by the pressure upon fastening e.g. tie rods. However, it is preferred to provide anode plate-securing holes 13 on the anode compartment frame on one hand and anode securing hooks 14 on the anode plates at positions corresponding to the holes 13 of the frame on the other hand, and to fit the hooks 14 into the holes 13 as shown in FIG. 1 so that the anode plates are securely fixed to the frame thus avoiding a dislocation of the anode plates at the time of assembling the electrolytic cell.

If the anode compartment frame 2 is made of a resin such as polyvinyl chloride, it is desirable to place a packing between the anode plates and the anode compartment frame. However, when the anode compartment frame is made of rubber, it is unnecessary to provide such a packing between the anode plates and the frame, as shown in FIG. 1.

The foraminous cathode plates 3 are of a low hydrogen over-voltage type which can be prepared by electro-codepositing Raney nickel particles on an expanded metal made of e.g. stainless steel and made flat by roll pressing. Like the above-mentioned anode plates, they have no flanges and are held against the respective sides of the cathode compartment frame. In the same manner as in the case of the anode plates, they can be secured to the respective sides of the cathode compartment frame by means of securing hooks. However, in the embodiment illustrated in FIG. 1, they are simply held against the sides of the frame without such hooks. If the cathode compartment frame is made of a resilient material, it is unnecessary to provide a packing between the cathode plates and the cathode compartment frame, as shown in FIG. 1. However, if a material having no or little resiliency such as a polyvinyl chloride resin is used for the cathode compartment frame, it is desirable to use a packing.

The cation exchange membrane 5 are made of a sheet of e.g. perfluorocarbon having carboxylic acid groups as ion exchange groups and having a thickness of from 100 to 300 μm, and they are suitable particularly for alkali metal chloride electrolysis or water electrolysis. The cation exchange membrane 5 is sandwiched between the foraminous anode plate 1 and the foraminous cathode plate 3 and held at the anode compartment frame and the cathode compartment frame. Usually, the cation exchange membrane 5 is thin and lacks in adequate resiliency and it is preferred to provide packings 6 and 7 between the cation exchange membrane and the foraminous anode plate and between the cation exchange membrane and the foraminous cathode plate, at the respective frame portions. However, in certain cases, only one packing 6 or 7 may suffice.

The foraminous anode plate and cathode plate are respectively provided with projections to which anode connecting plates 8 and cathode connecting plates 9 are respectively welded. The connecting plates 8 and 9 are connected to an anode bus bar 11 and a cathode bus bar (not shown), respectively. The manner of the connection to the bus bar is illustrated in FIG. 1 only with respect to the anode side, in which flexible connecting plates 10 are connected to the anode connecting plates 8 and the anode bus bar 11 is connected to the flexible connecting plates 10. By the presence of the flexible connecting plates, the connection between the electrolytic cell and the bus bar can be made flexible. Although not shown in the Figure, it is preferred that the same arrangement is employed for the cathode side as well.

It is desirable to minimize the distance between the anode and the cathode to reduce the cell voltage. For this purpose, an anode support 12 having a thickness slightly thicker than the thickness of the anode frame is inserted in the anode compartment to deflect the porous anode plates toward the porous cathode plates so that the distance between the anode and the cathode is thereby minimized or preferably the anode and cathode are brought into contact with the cation exchange membrane.

The anode support 12 illustrated in FIG. 1 is a pipe. However, it may be a resilient member such as a spring or a leaf spring.

As mentioned above, a desired number of cell units each comprising the porous anode plates, the porous cathode plates, the cation exchange membranes, the anode frame and the cathode frame, are repeatedly arranged and an anode side plate and a cathode side plate are disposed at their respective ends, and they are fastened by tie rods to form a filter press type electrolytic cell of the present invention.

The electrolytic cell thus assembled is free from leakage at the fastening portions in spite of the fact that porous electrode plates having no flanges are employed. Thus, the electrolytic cell can readily be manufactured.

Figure 2:
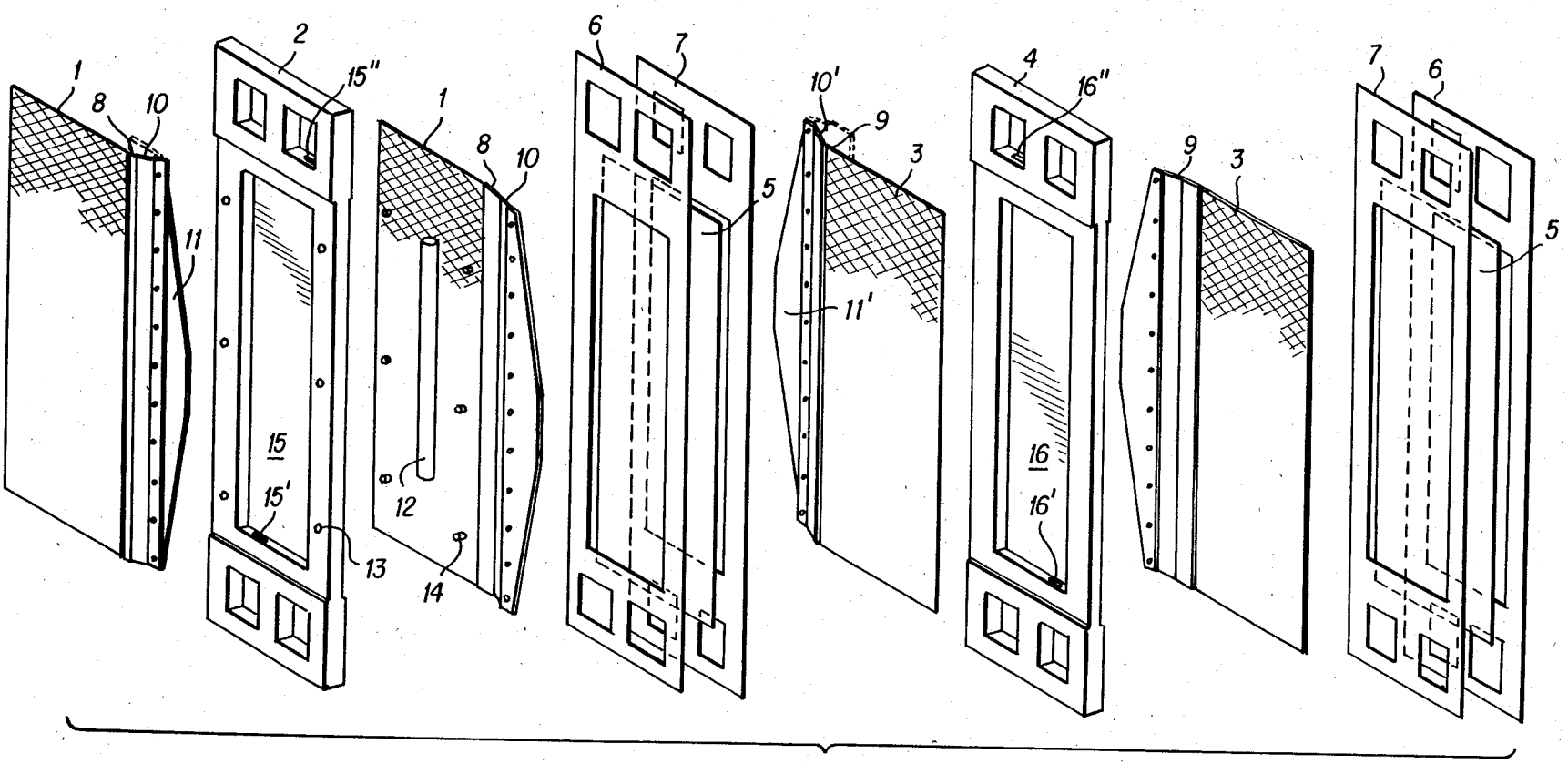
FIG. 2 is a plan view showing disassembled various parts of the electrolytic cell of FIG. 1 with the cation exchange membrane and the packing omitted.

FIG. 2 is a plan view showing disassembled various parts of the electrolytic cell of FIG. 1 with the cation exchange membrane and the packing omitted. The compartment frame 2 or 4 has four holes which constitute passages for the electrolytic solutions and the electrolyzed products.

Namely, the four holes constitute passages for the anode electrolytic solution, the electrolyzed product of the anode side, a cathode electrolytic solution and the electrolyzed product of the cathode side. In the case of the anode compartment frame, the passage for the anode electrolytic solution and the passage for the anode side electrolyzed product are respectively in communication with the anode compartment 15 having a hollow structure via communicating holes 15', 15''. Likewise, in the case of the cathode compartment frame, the passage for the cathode electrolytic solution and the passage for the cathode side electrolyzed product are respectively in communication with the cathode compartment 16 having a hollow structure via communicating holes 16', 16''.

Having thus described an embodiment where the electrolytic cell is a monopolar cell, it should be understood that the same construction is applicable also to a bipolar cell.

In the case of a bipolar electrolytic cell, the central opening of the compartment frame is divided by a partition into two compartments or chambers, and a foraminous anode plate is placed on one side of the compartment frame and a foraminous cathode plate is placed on the other side of the compartment frame so that the portion defined by the foraminous anode plate and the partition constitutes an anode compartment and the portion defined by the foraminous cathode plate and the partition constitutes a cathode chamber. The partition may be made of a conductive material such as a known bimetal, which may then be electrically connected to the foraminous anode plate and the foraminous cathode plate. Otherwise, the partition may be made of a non-conductive material, and the foraminous anode plate and the foraminous cathode plate provided in the abovementioned manner may then be made to protrude out of the electrolytic cell for electrical connection.

Now, a second preferred embodiment of the present invention will be described.

Figure 3:
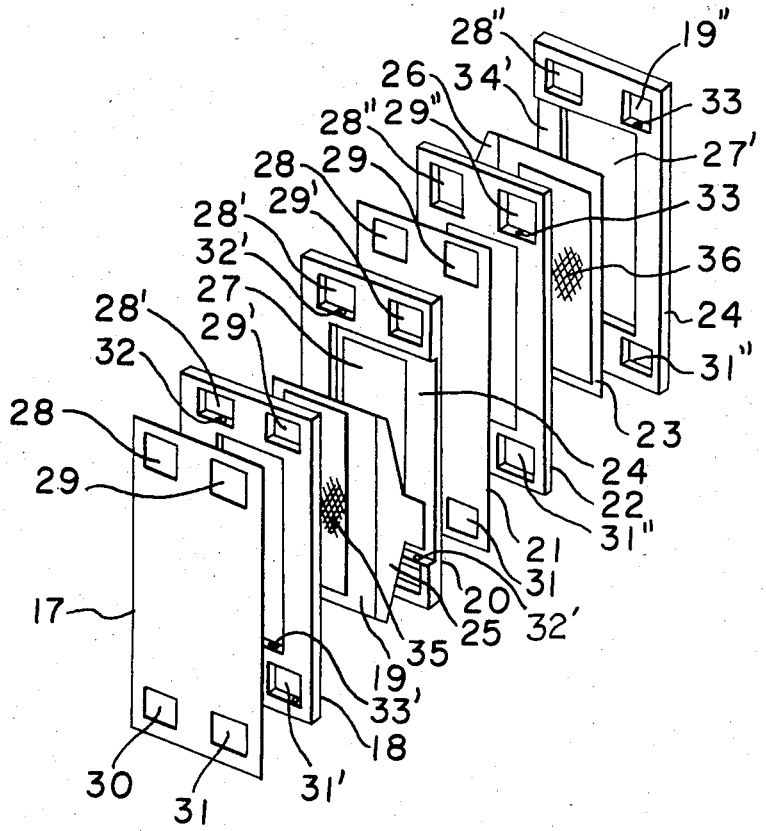
FIG. 3 is an exploded perspective view of another embodiment of the electrolytic cell of the present invention and illustrates a case where an electrode compartment frame is provided at each side of the cation exchange membrane.

FIG. 3 is a perspective view illustrating various parts of the second embodiment of the electrolytic cell of the present invention, in which an electrode compartment frame is provided on each side of the cation exchange membrane.

Cathode compartment frames 18 and 20 and anode compartment frames 22 and 24 are preferably made of a non-conductive elastic material such as natural rubber or synthetic rubber. One of the cathode compartment frames (i.e. the frame 20 in the illustrated embodiment) is provided with a recess in which a cathode conductive plate 19 fits. Likewise, one of the anode compartment frames (i.e. the frames 24 in the illustrated embodiment) is provided with a recess in which an anode conductive plate 23 fits.

The cathode compartment frames 18 and 20 and the anode compartment frames 22 and 24 may be made of a resin having little elasticity. In this case, it is desirable to insert a thin gasket between the frame and the electrode conductive plate. Each of the cathode compartment frames and anode compartment frames has an opening at its center and four holes having different functions in the vicinity of its corners, and the abovementioned cation exchange membrane 21 likewise has four holes having different functions.

The opening 27 of the cathode frame constitutes a cathode compartment, the opening 27' of the anode compartment frame constitutes a anode compartment. The holes 28, 28' and 28'' provided on the cation exchange membranes, the cathode compartment frames and the anode compartment frames, respectively, constitute a passage for a alkali metal hydroxide aqueous solution and a hydrogen gas. The holes 29, 29' and 29'' provided on the cation exchange membranes, the cathode compartment frames and the anode compartment frames, respectively, constitute a passage for a depleted brine solution and a halogen gas, or an alkali metal hydroxide aqueous solution and an oxygen gas. The holes 30, 30' and 30'' (30' and 30'' are not shown) provided on the cation exchange membranes, the cathode compartment frames and the anode compartment frames, respectively, constitute a passage of an electrolytic brine or an electrolytic alkali metal hydroxide aqueous solution (in the case of water electrolysis). The holes 31, 31' and 31'' provided on the cation exchange membrane, the cathode compartment frames and the anode compartment frames, respectively constitute a passage for water or a dilute alkali metal hydroxide aqueous solution. These holes are so located that when these parts are assembled to form a filter press type electrolytic cell, the respective holes coincide to form the respective passages.

The cathode compartment frames 18 and 20 are provided with fluid pathway slits or through-holes 32 and 32', respectively, which connect the hole 28' to the opening 27, and the hole 31' to the opening 27, respectively, so that a liquid and gas can flow therethrough. Likewise, the anode compartment frames 22 and 24 are provided with fluid pathway slits or through holes 33 and 33' (33' is not shown), respectively, which connect the hole 29'' to the opening 27' and the hole 30'' (not shown) to the opening 27', respectively, so that a liquid and gas can flow therethrough.

In an electrolytic cell having a structure as shown in FIG. 3, an electrolytic brine or an electrolytic alkali metal hyroxide aqueous solution (in the case of water electrolysis) flowing through the passage formed by the holes 30, 30' and 30'' (30' and 30'' are not shown) is introduced into the anode compartment 27' via the fluid pathway slit 33', and a depleted brine and a halogen gas after the electrolysis, or an alkali metal hydroxide solution and an oxygen gas after the electrolysis are withdrawn via the fluid pathway slit 33 to the passage formed by the holes 29, 29' and 29''. On the other hand, water or an alkali metal hydroxide solution flowing through the passage formed by the holes 31, 31' and 31'' is introduced into the cathode compartment 27 via the fluid pathway slit 32', and an alkali metal hydroxide aqueous solution and hydrogen after the electrolysis are withdrawn via the fluid pathway slit 33 to the passage formed by the holes 28, 28' and 28''.

One of the features of the second embodiment resides in the structure where the electrode plate is fit in the electrode compartment frame. Namely, a conductive plate smaller than the electrode compartment frame and slightly larger the electrode compartment is set on the electrode compartment frame to cover the electrode compartment, and another electrode compartment frame or the cation exchange membrane is placed against the other side of the conductive plate and tightened to form a filter press type assembly, whereby the following advantages are obtainable.

Namely, if the conductive plate had the same size as a gasket, it would be required to provide holes thereon corresponding to the holes 28, 29, 30 and 31, and consequently the conductive plate would be electrically connected to the fluid flowing through the holes, as mentioned above. In order to prevent the current leak from these portions, it would be required to cover these portions with a suitable non-conductive material, which would then add to the thickness and would likely to lead to a problem of leakage of the fluid. With the abovementioned construction of the second embodiment, not only such drawbacks can be eliminated but also the amount of the expensive electrode materials (i.e. especially titanium) can be reduced thus bringing about an additional merit of reduction of the costs.

The conductive plate is fit in the electrode compartment frame preferably in such a manner that on one side of the electrode compartment frame, a recess having a size and depth corresponding to the size and the thickness of the conductive plate is provided along the inner periphery forming the opening constituting the electrode compartment, whereby the conductive plate can be set on the recess with its surface being flush with the surface of the electrode compartment frame without being protruded therefrom, and thus the fluid leakage can thereby be avoided.

For the electrodes to be used in this second embodiment, the basic materials and active ingredients may be those which will be described hereinafter, and as their structure, the following has been found particularly preferred.

Namely, at least two projections are formed, by e.g. press forming, on a center portion of the condutive plate along its longitudinal direction, and an electrode plate is electrically and mechanically connected to the tops of the projections, whereby the cation exchange membrane can be brought in contact with or intimately fit on the anode 36 and the cathode 35, or the anode 36 and the cathode 35 can be brought to engage with each other with the cation exchange membrane inbetween. Thus, it is thereby possible to reduce the electrolytic cell voltage without impairing the current efficiency.

Referring to FIG. 3, the cathode plate 19 is fit in the recess 34 formed on the cathode compartment frame 20 and having the same configuration (i.e. the same size and thickness) as the cathode conductive plate 19, while the anode condutvive plate 23 is fit in the recess 34' formed on the anode compartment frame 24 and having the same configuration (i.e. the same size and thickness) as the anode condutive plate 23. A typical example of the configurations of the electrode plate and the electrode suitably used in the embodiment as shown in FIG. 3 is shown in FIG. 4.

Figure 4:
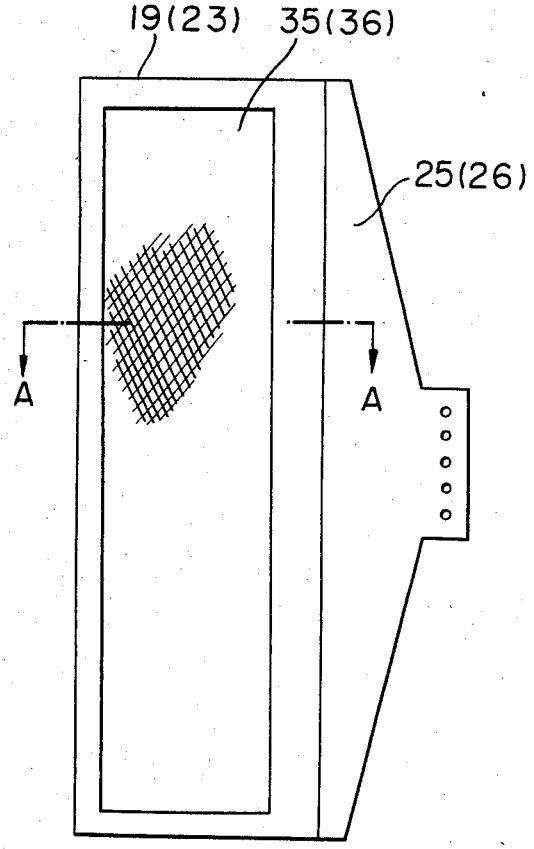
FIG. 4 illustrates a preferred construction of the conductive plate and electrode useful for the electrolytic cell of FIG. 3.
Figure 5:
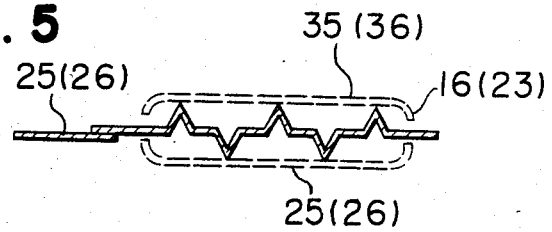
FIG. 5 is a cross sectional view taken along line A—A of FIG. 4.

FIG. 4 illustrates an example of a preferred construction of the conductive plate and the electrode to be used for the electrolytic cell of FIG. 3. The electrode 35 or 36 slightly smaller than the condutive plate 19 or 23 is electrically connected to the conductive plate 19 or 23. A conductive bus bar 25 or 26 for supplying electric current to the conductive plate 19 or 23 is electrically and mechanically connected to the conductive plate. FIG. 5 is a cross section taken along the line A—A of FIG. 4.

FIG.5 illustrates a preferred construction of the conductive plate and the electrode to be used for the electrolytic cell of FIG. 3. The configurations of the projections along the longitudinal direction of the conductive plate 19 or 23 are not limited to the particular configurations illustrated, and they may be in a semi-circular or semi-oval shape or in a form of plate-shaped ribs, etc. The electrode 35 or 36 is electrically and mechanically connected to the tops of the projections of the condutive plate 19 or 23 to form a flat configuration. Further, the ends of the electrode 35 or 36 are preferably bent toward the conductive plate to avoid the rupture of the cation exchange membrane. In a case where the anode and the cathode are brought to engage with each other, the electrodes 35 and 36 are selected to have elastisity. It is preferred to use an expanded metal having a major length of from 3 to 20 mm, a minor length of from 1.5 to 10 mm, and a strand width of from 0.2 to 2 mm. Further, the height of the projections is preferably from 3 to 30 mm. The thickness of the conductive plate is preferably from 0.5 to 5 mm.

Figure 6:
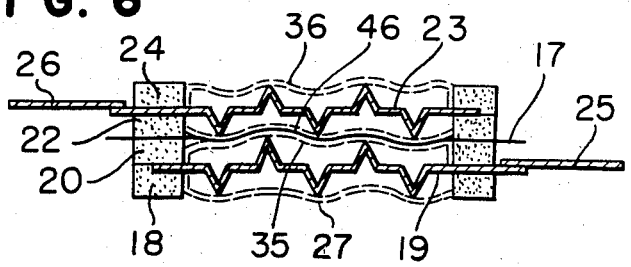
FIG. 6 is a cross sectional view illustrating an electrolytic cell in which the anode and cathode are assembled to engage with each other.

FIG. 6 illustrates an embodiment wherein the anode 36 and the cathode 35 are assembled to engage with each other.

Namely, the projections of the cathode conductive plate 19 are located at intermediate positions between the projections of the anode conductive plate 23. The height of the projections relative to the thickness of the electrode compartment frames are adjusted so that when the electrode compartment frames are tightened, the anode and the cathode will be brought to engage with each other. Thus, upon assembling the electrolytic cell as shown in FIG. 3 and tightening it, the anode 36 and the cathode 35 can be brought to engage with each other. The degree of the engagement of the anode and the cathode is to such an extent that the anode 36 and the cathode 35 are thereby brought in contact with or intimately fit on the cation exchange membrane 17, and it is usually from 0 to 3 mm. If the degree of the engagement exceeds 3 mm, the cation exchange membrane will be pressed excessively thus leading to the rupture of the cation exchange membrane.

From the foregoing, it should be understood that the electrolytic cell of the second embodiment is simple in structure, superior in efficiency and economical. Another feature of this embodiment is that the weight of the electrolytic cell is substantially lighter than the conventional electrolytic cells, whereby the assembling and transportation operations can readily be done.

The electrolytic cell of this embodiment is assembled by putting a number of repeating units together, each unit consisting of the combination of FIG. 3, and tightening them by tie rods with rigid fastening members placed at their both ends. The fastening members are required to have a substantial weight, but even with such fastening members, it is possible to reduce the overall weight of the assembled electrolytic cell.

As the ion exchange membrane to be used in the present invention, there may be mentioned a polymer containing cation exchange groups such as carboxylic acid groups, sulfonic acid groups, phosphoric acid groups or phenolic hydroxyl groups. As such a polymer, a fluorine-containing polymer is particularly preferably used. Suitable fluorine-containing polymers having ion exchange groups include copolymers of a vinyl monomer such as tetrafluoroethylene and chlorotrifluoroethylene with a perfluorovinyl monomer having ion-exchange groups such as sulfonic acid groups, carboxylic acid groups or phosphoric acid groups, or reactive groups which can be converted to such ion exchange groups. It is also possible to use a membrane of a polymer of trifluorostyrene to which ion exchange groups such as sulfonic acid groups are introduced, or a polymer of styrenedivinylbenzene to which sulfonic acid groups are introduced.

In a case where a fluorine-containing cation exchange membrane having a carboxylic acid group content of from 0.5 to 2.0 miliequivalence per gram of the dried resin of such a copolymer, is used, the current efficiency as high as at least 90% is obtainable even when the sodium hydroxide concentration is at least 40%. It is particularly preferred that the carboxylic acid group content per gram of the abovementioned dried resin is from 1.12 to 1.7 miliequivalence, whereby highly concentrated sodium hydroxide as mentioned above can continuously be obtained with high current efficiency for a long period of time. In the case of water electrolysis, the ion exchange group content is from 0.5 to 2.5 miliequivalence, preferably from 1.12 to 2.0 miliequivalence. Further, the cation exchange membrane to be used in the present invention may be formed by blending an olefin polymer such as polyethylene or polypropylene, preferably a fluorine-containing polymer such as polytetrafluoroethylene or a copolymer of ethylene and tetrafluoroethylene, at the time of the membrane formation, as the case requires. Otherwise, it is also possible to reinforce the membrane by using a support such as a cloth, a woven fabric such as a net or a non-woven fabric which is made of such a polymer, or wires, a net or a perforated plate made of metal.

In the present invention, the cation exchange membrane as mentioned above may be used per se. However, it is preferred to use the following type of a cation exchange membrane, whereby the cell voltage can further be reduced.

Namely, a gas and liquid permeable non-electrode porous layer is formed on the surface of the cation exchange membrane, and the anode or the cathode is arranged via such a layer. When an alkali metal chloride solution is electrolyzed in an electrolytic cell having such an arrangement, it is possible to obtain an alkali metal hydroxide and chlorine at an unexpectedly low voltage.

With such an arrangement, the electrodes are arranged via the abovementioned gas and liquid permeable porous layers, and they do not directly contact the membranes. Accordingly, the anodes are not required to have great alkaline resistance, and conventional electrodes having chlorine-resistance can be used. Further, the electrodes may not be bonded to the membranes or the porous layers, and thus their life is independent from the life of the membranes, i.e. they do not become useless depending upon the life of the membranes.

With such an arrangement, the cell voltage becomes unexpectedly low, and remarkably lower than the case where an alkali metal chloride is electrolyzed in an electrolytic cell in which the anodes and cathodes are in direct contact with the cation exchange membranes without interposition of the abovementioned porous layers. As opposed to the case where the electrodes are intimately contacted with the membranes as disclosed in Japanese Laid-Open Patent Application No. 112398/79, such a low cell voltage is attainable even when the abovementioned porous layer is formed by a layer of substantially non-conductive non-electrode particles, and thus this should be regarded as a totally unexpected effect.

The gas and liquid permeable and corrosion resistant porous layer is inactive as an anode or cathode. Namely, it is made of a material such as a non-conductive material having greater oxygen overvoltage or hydrogen overvoltage than the electrode disposed via the porous layer. As such a material, there may be mentioned a single substance or a mixture of oxides, nitrides, carbides of such elements as titanium, zirconium, niobium, tantalum, vanadium, manganese, molybdenum, tin, antimony, tungsten, bismuth, indium, cobalt, nickel, beryllium, aluminum, chromium, iron, potassium, germanium, selenium, yttrium, silver, lanthanum, cerium, hafnium, lead, thorium, and rare earth elements.

As the material for the anode side, preferred is a single substance or a mixture of oxides, nitrides or carbides of such elements as titanium, zirconium, niobium, tantalum, vanadium, manganese, molybdenum, tin, antimony, tungsten and bismuth.

As the material for the cathode side, preferred is a single substance or a mixture of oxides, nitrides or carbides of such elements as titanium, zirconium, niobium, tantalum, indium, tin, manganese, cobalt and nickel.

When a porous layer of the present invention is formed by such a material, the material is used in a form of powder or particles preferably in combination with a suspension of a fluorine-containing polymer such as polytetrafluoroethylene. If necessary, a surfactant may be used to obtain a homogeneous mixture of the two components. The mixture is applied to the ion exchange membrane to form a layer thereon, and pressure of heat is applied to the ion exchange membrane to bond or preferably partially embed the layer to the membrane.

The physical properties of these porous layers may be substantially the same for the anode and cathode sides, and it is suitable that they have an average pore size of from 0.01 to 2000$\mu$, a porosity of from 10 to 99%, and an air permeability of from $1\times10^{-5}$ to 10 moles/cm$^2$·mm·cm Hg.

If their properties fall outside of any one of the abovementioned ranges, it is likely that the desired low cell voltage can not be attained or the reduction of the cell voltage becomes unstable. Particularly preferred ranges of the properties are such that the average pore size is from 0.1 to 1000$\mu$, the porosity is from 20 to 98% and the air permeability is from $1\times10^{-4}$ to 1 mole/cm$^2$·mm·cm Hg, whereby the electrolytic operation can be carried out constantly at a stabilized low cell voltage.

The thickness of the porous layer may be determined depending upon the nature and physical properties of the material to be used, and it should not be less than the thickness of the cation exchange membrane on which the layer is formed, and is usually from 0.1 to 500$\mu$, preferably from 1 to 300$\mu$.

If the thickness is not in the abovementioned range, it is likely that the electric resistance becomes high, the removal of gas becomes difficult or the transfer of the electrolytic solution becomes difficult.

In this case, the electrode may preferably be brought in contact with the porous layer. It is possible to provide an electrode, i.e. an anode or cathode, on only one side of the ion exchange membrane. However, it is preferred to provide an electrode on each of the anode and cathode sides of the ion exchange membrane, so as to attain better reduction of the electrolytic cell voltage.

In practice, when the electrode is to be provided via the abovementioned porous layer, the procedure may be such that a powder to form the porous layer is applied to the ion exchange membrane by e.g. screen printing and then heat pressed to form a porous layer on the surface of the ion exchange membrane, and the electrode is pressed against the surface of the porous layer.

Now, the compartment frames to be used in the present invention will be described.

As the electrode compartment frames of the present invention, there may be used those disclosed in Japanese Laid-Open Patent Application No. 108899/78. Namely, they may be readily manufactured by providing an opening for constituting an electrode compartment at a center portion of a plate made of a non-conductive flexible material such as a polyvinyl chloride resin or a non-conductive flexible and elastic material such as natural rubber or synthetic rubber such as EPDM, and holes smaller than the opening at the four corners of the plate to constitute passages for the electrolytic solution, and the electrolyzed products.

As a result of a further study, it has been found that the cell voltage can further be reduced in a case where the ratio of the height of the electrode compartment to the thickness of the compartment frame falls within a certain specific range.

Namely, the above effectiveness is obtainable when the said ratio is preferably from 20 to 500, more preferably from 30 to 350. In a conventional electrolytic cell in which a cation exchange membrane is used, it used to be a decisive factor influencing the cell voltage that how quickly the gas generated at the electrode can be withdrawn from the electrode compartment, and it used to be impossible to substantially minimize the thickness of the compartment frame (i.e. in the case a spacer is used, the thickness of the compartment frame includes the thickness of the spacer) relative to the height of the electrode compartment, whereby a filter press electrolytic cell thereby obtainable tended to be long relative to the number of cells used. For the same reason, an attempt to increase the height of the electrolytic cell was believed to be impossible since the length of the filter press electrolytic cell would then be too long. For this reason, in the conventional electrolytic cell, the said ratio used to be at most about 30.

It has now been found that with use of the cation exchange membranes having, on at least one side thereof, a non-electrode porous layer, the electrolysis can be conducted at a low electrolytic voltage even when the said ratio is high. The reasons for this effectiveness are not yet clearly understood. However, the present inventors consider that with use of the cation exchange membranes provided with the porous layers, the deposition or retention of the gas generated by the electrolysis, on the membrane surface, can be minimized and the gas can quickly be removed.

The sizes of the cathode compartment frames and the anode compartment frames vary depending upon the production capacity of the particular electrolytic cell. For the purpose of industrial application, it is convenient that the said thickness is from 3 to 50 mm and the said height is from 250 to 5000 mm. Within the above ranges of the size, the ratio of the height to the thickness may be selected to fall within a range of from 20 to 500.

Now, the electrodes to be used in the present invention will be described. The electrode is a foraminous electrode made of a perforated material such as an expanded metal, a punched metal or wire meshes and being a gas and liquid permeable type. There is not particular restriction as to the means to impart the electrode activity to the electrode. The anode may be the one prepared by coating the abovementioned perforated electrode base material with a known electrode active component, for instance, a platinum group metal such as platinum, palladium, rhodium or ruthernium; an alloy thereof; or an oxide of a platinum group metal or an alloy of a platinum group metal. The cathode may be a foraminous electrode made of metal such as iron, stainless steel or nickel. However, the cathode is preferably the one obtained by subjecting stainless steel to etching treatment as disclosed in Japanese Laid-Open Patent Application No. 102279/78, or the one electroplated with developed or undeveloped Raney alloy particles. Now, the invention will be described in more detail with reference to Examples.

EXAMPLE 1

Compartment frames made of EPDM and having a size of 1400 mm×260 mm×10 mm were prepared which had a center opening (i.e. electrode compartment) of 1000 mm×200 mm and four corner holes. Out of the four holes, two holes located at the upper portions and a size of 150 mm×90 mm, and two holes located at the lower portions had a size of 70 mm×70 mm.

Foraminous anode plates having a size of 1060 mm×290 mm were prepared which were obtained by coating ruthenium oxide on an expanded metal made of titanium, made flat by roll pressing and having perforations with a major length of 8 mm and a minor length of 4 mm and a thickness of 1.0 mm.

On the other hand, foraminous cathode plates having a size of 1060 mm×290 mm were prepared which were obtained by electroplating Raney nickel on an expanded metal made of nickel, made flat by roll pressing and having perforations with a major length of 8 mm and a minor length of 4 mm and a thickness of 0.8 mm.

Along one of the vertical edges of each foraminous anode plate and each foraminous cathode plate, an anode-connecting plate made of titanium and having a size of 1000 mm×40 mm and a cathode-connecting plate made of nickel and having a size of 1000 mm×40 mm were respectively attached by welding, to which an anode side flexible connecting plate and a cathode side flexible connecting plate were respectively attached.

Along the peripheral portion of each anode compartment frame, anode plate-securing holes were provided, and anode-securing hooks were provided on each porous anode plate at positions corresponding to the securing-holes.

Cation exchange membranes were prepared which were composed of a membrane made of a copolymer of tetrafluoroethylene with $CF_2{=}CFO(CF_2)_3COOCH_3$ and having an ion exchange capacity of 1.45 meq/g. resin, and a thickness of 250$\mu$, and porous layers formed by coating $TiO_2$ powder on the anode side of the membrane and SiC powder on the cathode side of the membrane in an amount of 1 mg/cm$^2$, respectively.

Fifty unit electrolytic cells as shown in FIG. 1 and comprising the abovementioned porous anode plates, porous cathode plates, anode compartment frames, cathode compartment frames and cation exchange membranes, were arranged to form a filter press type electrolytic cell and tightened by tie rods with the end plates placed at both ends. An anode bus bar was bolted to each anode side flexible connecting plate, and a cathode bus bar was bolted to each cathode side flexible connecting plate. At this stage, a titanium pipe having an outer diameter of 12 mm and a length of 700 mm was inserted in the center portion of each anode compartment to slightly outwardly deflect each porous anode plate so that the anode plate and the adjacent cathode plate were brought in contact with the cation exchange membrane.

While supplying a sodium chloride aqueous solution having a concentration of 300 g/l. into the anode compartments of the electrolytic cell thus assembled and water into the cathode compartments, sodium chloride electrolysis was conducted at 20 A/dm$^2$ at 90° C.

The sodium hydroxide aqueous solution thereby formed had a concentration of 35%, the chlorine gas had a purity of 97.4% and the current efficiency in the cathode side was 94.4%. The electrolysis was continued for 60 days. During the period, the cell voltage remained at a level of 2.96 V and no liquid leakage was observed.

EXAMPLE 2

In the same manner as in Example 1, a bipolar electrolytic cell was assembled except that a partition of a tetrafluoroethylene resin having a size of 1060 mm×260 mm×10 mm was provided in the center opening of each compartment frame similar to the one used in Example 1 except for the thickness being 2.0 mm, the porous anode plate was provided on one side of the compartment frame and the porous cathode plate was provided on the other side of the compartment frame, a titanium anode support having an outer diameter of 7 mm and a length of 700 mm was inserted between the partition and the porous anode plate, and both electrodes were electrically connected outside of the electrolytic cell.

Further, at one end of the electrolytic cell, an anode conductive plate was used instead of the anode end plate, and it was connected to a positive power source, while at the other end of the electrolytic cell, a cathode conductive plate was used instead of the cathode end plate, and it was connected to a negative power source.

The electrolytic conditions were the same as in Example 1. The electrolytic performance was as follows:

Sodium hydroxide concentration: 35%

Purity of chlorine gas: 97.4%

Current efficiency at the cathode side: 94.4%

Cell voltage (an average value per cell): 2.91 V.

No liquid leakage was observed during the period of the electrolysis.

EXAMPLE 3

The operation was conducted in the same manner as in Example 1 except that the electrode plates, the thickness of the cation exchange membranes and the current density in Example 1 were changed as follows:

Electrode plates: Porous anode plates were prepared from a titanium plate having a size of 1060 mm×290 mm×1 mm (thickness) by punching it out to form rhombic perforations having a major length of 8.0 mm and a minor length of 4.0 mm and with a strand width of 1.2 mm, within an area of 1000 mm×200 mm at the center portion of the plate, and coating it with ruthenium oxide. Porous cathode plates were prepared by electroplating Raney nickel particles on an iron base plate having the same shape as the abovementioned anode plate in an amount of 3 g/dm$^2$.

The thickness of the cation exchange membranes: 140μ.

The current density: 30 A/dm$^2$.

As the electrolytic performance, the cell voltage was 3.03 V and the current efficiency was 93.5%, and these values remained unchanged during the electrolysis for 60 days. During the period, no liquid leakage was observed.

EXAMPLE 4

An electrolytic cell as shown in FIG. 3 was assembled in which a height and a width of an anode compartment and a cathode compartment are 1000 mm and 200 mm, respectively and in which the thickness of the anode compartment frames and the cathode compartment frames was 7 mm (the ratio of the height to the thickness being 143). An anode conductive plate as shown in FIG. 5 was prepared from a titanium plate having a thickness of 1 mm by forming projections having a height of 7 mm, and an anode made of a titanium expanded metal having a major length of 6 mm, a minor length of 3 mm and a thickness of 0.5 mm and coated with palladium oxide was attached on the tops of the projections of the anode conductive plate by electric resistance welding. A cathode conductive plate as shown in FIG. 5 was prepared from an iron plate having a thickness of 1 mm by forming projections having a height of 3.5 mm, and a cathode made of an iron expanded metal having a major length of 6 mm, a minor length of 3 mm and a thickness of 0.5 mm and electroplated with Raney nickel was attached to the tops of the projections of the cathode conductive plate by electric resistance welding.

73 mg. of tin oxide powder having a particle size of at most 44μ was suspended in 50 cc of water, and a polytetrafluoroethylene (PTFE) suspension (Tradename: Teflon 30J, manufactured by DuPont Co.) was added thereto so that the amount of PTFE became 7.3 mg. A drop of a non-ionic surfactant (Tradename: Tritone X-100, manufactured by Rohm & Haas Co.) was added thereto, and the mixture was stirred by a supersonic stirrer under cooling with ice, and then vacuum-filtered on a porous PTFE membrane, whereupon a porous tin oxide thin layer was obtained.

This thin layer had a thickness of 30μ, a porosity of 73% and an air permeability of $3.8\times10^{-3}$ mole/cm$^2$·min.cmHg and contained 5 mg/cm$^2$ of tin oxide.

On the other hand, in a manner similar to the above, a thin layer containing 7 mg/cm$^2$ of nickel oxide of at most 44μ and having a thickness of 35μ, a porosity of 73%, and an air permeability of $3.5\times10^{-3}$ mole/cm$^2$·min.cmHg, was obtained.

The respective thin layers were laminated on both sides of an ion exchange membrane made of a copolymer of tetrafluoroethylene with $CF_2{=}CFO(CF_2)_3COOCH_3$ so that the porous PTFE membranes were located outside the ion exchange membrane, and the lamination was pressed under the conditions of a temperature being 160° C. and pressure being 60 kg/cm$^2$ to fix the porous thin layers on the ion exchange membrane, and thereafter the porous PTFE membranes were removed, whereupon an ion exchange membrane having porous layers of tin oxide and nickel oxide fixed on the respective sides was obtained. The size of this cation exchange membrane having the porous layers was 1060 mm in height and 260 mm in width and thus was large enough to cover the electrode compartment.

The anode compartment frames and the cathode compartment frames were made of synthetic rubber, and the holes provided thereon corresponding to the holes 30 and 31 of FIG. 3 has a size of 70×70 mm and the holes corresponding to the holes 28 and 29 and a size of 70×150 mm.

In the same construction as shown in FIG. 3, an electrolytic cell comprising two anode conductive plates attached with anodes and three cathode conductive plates attached with cathodes was assembled so that the degree of the engagement of the anodes with the cathodes became about 1 mm. A total of 1.6 KA of electric current was conducted. An apparent current density was 20 A/dm$^2$.

2.5 l./hr. of pure water was supplied to the passage corresponding to the hole 31, and 23 l./hr. of an aqueous sodium chloride solution of 300 g./l was supplied to the passage corresponding to the hole 30. The operation was continued at a temperature of 90° C. for 20 days. The results thereby obtained were such that the concentration of the aqueous sodium hydroxide solution formed was 35%, the purity of the chlorine gas was 97.4%, and the current efficiency measured at the cathode side was 94.4%.

During the period, no leakage of the liquid from the electrolytic cell was observed, and the sodium chloride concentration in the formed sodium hydroxide was about 35 mg/l. Further, the cell voltage was 2.96 V.

EXAMPLE 5

To 10 parts of a viscosity controlling agent of an aqueous solution of 2% by weight of methyl cellulose, 2.5 parts of an aqueous dispersion containing 7.0% by weight of modified polytetrafluoroethylene having a particle size of at most 1μ (i.e. particles of polytetrafluoroethylene coated with a copolymer of tetrafluoroethylene with $CF_2{=}CFOCF_2COOCH_3$, hereinafter referred to simply as modified PTFE) and 5 parts of titanium oxide powder having a particle size of at most 25μ, were mixed, and after adequately mixing them, 2 parts of isopropyl alcohol and 1 part of cyclohexanol were added. The mixture was again kneaded, whereupon a paste was obtained.

The paste was screen-printed over an area of 1060 mm×260 mm on one side of an ion exchange membrane made of a copolymer of polytetrafluoroethylene $CF_2{=}CFO(CF_2)_3COOCH_3$ and having an ion exchange capacity of 1.70 meq/g. dried resin and a thickness of 210μ with use of a printing plate comprising a screen of stainless steel having 200 meshes and a thickness of 60μ and a screen mask provided therebeneath and having a thickness of 8μ, and a polyurethane squeegee.

The printed layer formed on the ion exchange membrane was dried in the air and the paste was thereby solidified. In the same manner, titanium oxide having a particle size of at most 25μ was screen printed on the other side of the ion exchange membrane. Thereafter, the printed layers were press-fixed on the ion exchange membrane at a temperature of 140° C. and under pressure of 30 kg/cm² and the immersed in an aqueous solution of 25% by weight of potassium hydroxide at 90° C. to hydrolyze the ion exchange membrane and to elute the methyl cellulose.

The titanium oxide layer thus formed on the ion exchange membrane had a thickness of 20μ and a porosity of 70% and contained 1.5 mg/cm² of titanium oxide.

Then, an expanded metal of nickel (a minor length of 2.5 mm and a major length of 5.0 mm) at the anode side of the ion exchange membrane and an expanded metal of SUS 304 (a minor length of 2.5 mm and a major length of 5.0 mm) at the cathode side, were subjected to etching treatment in a 52% sodium hydroxide aqueous solution at 150° C. for 52 hours, and the cathode thus treated to have a low hydrogen overvoltage was pressed against the ion exchange membrane under pressure of 0.01 kg/cm². While supplying a 30% potassium hydroxide aqueous solution to the anode compartments and water to the cathode compartments, and maintaining the potassium hydroxide concentration in the anode and cathode compartments at a level of 20%, the electrolysis was conducted at 100° C., whereupon the following results were obtained.

| Current density (A/cm²) | Cell Voltage (V) |
|---|---|
| 40 | 1.87 |
| 66 | 2.12 |

EXAMPLES 6 to 12

The electrolysis was conducted in the same manner as in Example 4 except that the height and the thickness of the cathode compartment frames and the anode compartment frames and the height of the electrodes and the cation exchange membranes provided with a nonelectrode porous layer, were changed as shown in Table 1. The results thereby obtained are also shown in Table 1.

TABLE 1

| Examples | 6 | 7 | 8 | 9 | 10 | 11 | 12 |
|---|---|---|---|---|---|---|---|
| Height of cathode and anode compartment (h mm) | 1000 | 1000 | 1500 | 1500 | 1600 | 1000 | 1500 |
| Thickness of cathode and anode compartment (w mm) | 20 | 10 | 10 | 7 | 3 | 10 | 2 |
| h/w | 50 | 100 | 150 | 215 | 333 | 100 | 750 |
| Height of the electrodes (mm) | 1060 | 1060 | 1560 | 1560 | 1060 | 1060 | 1560 |
| Height of the cation exchange membranes (mm) | 1060*1 | 1060*1 | 1560*1 | 1560*1 | 1060*1 | 1060*2 | 1560*1 |
| Cell voltage (V) | 2.95 | 2.95 | 2.96 | 2.97 | 3.05 | 3.14 | 3.50 |
| Current efficiency (%) | 94.3 | 94.2 | 94.0 | 94.1 | 94.0 | 94.5 | 93.0 |

*1Non-electrode porous layer provided
*2No non-electrode porous layer provided

EXAMPLE 13

The electrolysis was conducted in the same cell as in Example 1 except that the cation exchange membranes were made of a copolymer of $CF_2{=}CF_2$ with $CF_2{=}CFOCF_2CF(CF_3)OCF_2CF_2SO_2F$ (the ion exchange capacity: 0.87 meq/g dried resin. The membrane thickness:300μ) and had no porous layer on either side, the electrolytic conditions were such that an electrolytic temperature was 90° C., the current density was 30 A/dm², the sodium hydroxide concentration in the cathode compartments was 35% by weight and the sodium chloride concentration in the anode compartments was 220 g./l.

The electrolytic performance thereby obtained was such that the cell voltage was 3.41 V and the current efficiency was 91%.

We claim:

1. In a filter press type ion exchange membrane electrolytic cell comprising an anode compartment and a cathode compartment partitioned by a cation exchange membrane and being useful for obtaining a halogen, hydrogen and an alkali metal hydroxide from an alkali metal halide aqueous solution, or oxygen and hydrogen from an aqueous alkaline solution, an improvement characterized by:

(a) an anode compartment frame and a cathode compartment frame, each having an essentially rectangular opening at its center constituting the non-conductive anode compartment or the non-conductive cathode compartment and four holes in the vicinity of its corners constituting passages for (1) an alkali metal halide aqueous solution or an aqueous alkaline solution, (2) a depleted brine and a halogen gas, or an aqueous alkaline solution and an oxygen gas, (3) water or a dilute alkali metal hydroxide aqueous solution and (4) an alkali metal hydroxide aqueous solution and a hydrogen gas, the former two holes being in communication with the opening constituting the anode compartment, and the latter two openings being in communication with the opening constituting the cathode compartment, (b) a cation exchange membrane having four holes at positions corresponding to the four holes provided on the anode compartment frame and the cathode compartment frame, or a cation exchange membrane having no such four holes and being smaller than said compartment frame but slightly larger than said openings of the compartment frames, (c) an anode and a cathode having no four holes and being slightly larger than the openings of the anode compartment frame and the cathode compartment frame and smaller than the compartment frames, wherein a unit comprising said cathode compartment frame and said cathode disposed on each side thereof and a unit comprising said anode compartment frame and said anode disposed on each side thereof are alternately arranged via said cation exchange membrane, or wherein a unit comprising said anode and said anode compartment frame disposed on one side or each side thereof and a unit comprising said cathode and said cathode compartment frame disposed on one side or each side thereof are alternately arranged via said cation exchange membrane.

2. The filter press type electrolytic cell according to claim 1 wherein a gas and liquid permeable porous non-electrode layer is bonded to at least one side of the cation exchange membrane.

3. The filter press type electrolytic cell according to claim 2 wherein said gas and liquid permeable porous non-electrode layer is thinner than the cation exchange membrane and has a thickness of from 0.1 to 500$\mu$ and a porosity of from 10 to 99%.

4. The filter press type electrolytic cell according to claim 3 wherein the anode is attached to an anode conductive plate and the cathode is attached to a cathode conductive plate, and said anode conductive plate is, at its one side, in contact with the anode compartment frame and provided at the other side with said cation exchange membrane with or without interposition of another anode compartment frame and said cathode conductive plate is, at its one side, in contact with the cathode compartment frame and provided at the other side with said cation exchange membrane with or without interposition of another cathode compartment frame.

5. The filter press type electrolytic cell according to claim 1 wherein each of said anode and cathode is made of a substantially flat foraminous electrode plate and shaped so that the electrode portion of said electrode plate is flush with the sealing portion thereof facing to said anode compartment frame and cathode compartment frame.

6. The filter press type electrolytic cell according to claim 5 wherein said electrode plate is an expanded metal made flat by roll pressing.

7. The filter press type electrolytic cell according to claim 5 wherein said electrode plate is a punched metal made of a flat plate provided with perforations.

8. The filter press type electrolytic cell according to claim 5 wherein an elastic sheet material is provided at the sealing portions as a liquid-tight sealing member.

9. The filter press type electrolytic cell according to claim 1 wherein the anode and the cathode are in contact with or intimately adhered to the cation exchange membrane.

10. The filter press type electrolytic cell according to claim 9 wherein the anode and the cathode are engaged with each other.

11. The filter pressed type electrolytic cell according to claim 10 wherein said anode compartment frame has, on its surface contacting the anode conductive plate, a recess having a size and depth corresponding to the size and thickness of the anode conductive plate or said cathode compartment frame has, on its surface contacting the cathode conductive plate, a recess having a size and depth corresponding to the size and thickness of the cathode conductive plate.

12. The filter press type electrolytic cell according to claim 11 wherein the anode or the cathode is attached to the tops of slender projections formed on a chlorine-resistant or oxidation-resistant metal conductive plate or an alkaline-resistant metal conductive plate, in parallel with the conductive plate.

13. The filter press type electrolytic cell according to claim 12 wherein the ratio of the height of the electrode compartment to the thickness of the anode compartment frame and/or the cathode compartment frame is from 20 to 500.

* * * * *